United States Patent [19]

Salvagnini

[11] 4,391,123

[45] Jul. 5, 1983

[54] AUTOMATIC PUNCHING MACHINE

[75] Inventor: Guido Salvagnini, Arzignano, Italy

[73] Assignee: Salvagnini Transferica S.p.A., Italy

[21] Appl. No.: 178,565

[22] Filed: Aug. 15, 1980

[30] Foreign Application Priority Data

Sep. 12, 1979 [IT] Italy ..... 25676 A/79

[51] Int. Cl.[3] ..... B26F 1/04

[52] U.S. Cl. ..... 72/464; 83/36; 83/71; 83/412; 83/418; 83/519; 83/648

[58] Field of Search ..... 234/107–109, 234/115; 83/71, 513–519, 410, 412, 414, 415, 36, 418, 421, 549–551, 648; 72/7, 464

[56] References Cited

U.S. PATENT DOCUMENTS

| | | | |
|---|---|---|---|
| 3,436,998 | 4/1969 | Maceyka et al. | 83/412 |
| 3,738,569 | 6/1973 | Killaly | 83/513 |
| 4,023,788 | 5/1977 | Herb et al. | 83/414 X |
| 4,052,780 | 10/1977 | Daniels | 83/552 X |
| 4,165,667 | 8/1979 | Brolund | 83/412 X |
| 4,235,139 | 11/1980 | Haenni et al. | 83/418 |

FOREIGN PATENT DOCUMENTS

| | | | |
|---|---|---|---|
| 1502721 | 1/1970 | Fed. Rep. of Germany | 83/549 |

*Primary Examiner*—James M. Meister
*Attorney, Agent, or Firm*—Yount & Tarolli

[57] ABSTRACT

The punching machine of this invention comprises a punching head provided with a plurality of punch/die pairs for effecting punching operations of a metal sheet. In the punching head there are defined a plurality of operative positions in each of which there is positioned and actuated a punch/die pair of the said plurality of punch/die pairs. Each punch/die pair is operated independently from the others. The punching machine further includes a numerically controlled programmable manipulator equipped with pincers for gripping a metal sheet and displacing it between the punchs and dies of said plurality of punch/die pairs.

6 Claims, 9 Drawing Figures

AUTOMATIC PUNCHING MACHINE

BACKGROUND OF THE INVENTION

The present invention relates to an automatic punching machine, particularly one suitable for performing punching of a metal sheet in a programmed and programmable manner according to a predetermined number of different punching shapes.

The punching machine of this invention is of the type comprising a punching head provided with a plurality of punch/die pairs for effecting the desired punching of a metal sheet, and a numerically controlled programmable manipulator, equipped with gripping means for the said metal sheet, for displacing it over a horizontal plane passing between the said punches and their associated dies.

In known punching machines of the said type there exists a single, well determined and unchangeable operative position, into which each punch/die pair is carried by appropriate automatic means and retained for the time necessary for the execution of all the punchings of the same predetermined shape envisaged in a metal sheet.

In operation of such a known punching machine, whilst a first punch/die pair is maintained in the said operative position the manipulator causes the displacement of the metal sheet in such a way that the said pair performs the predetermined number of identical punchings in a corresponding number of predetermined and different positions in the said metal sheet. Once this first series of punchings has been completed the punch/die pair first considered is replaced with another pair of different shape to effect a second series of punchings on the same metal sheet.

This mode of operation, which is tied to the structural and functional characteristics of the known punching machine and, above all, to the fundamental characteristic consisting in a single and unchangeable operative position, involves dead times which until now were inevitable, for the substitution of the punch/die pair in the operative position, as well as a not inconsiderable consumption of time tied to the movements which the manipulator must perform in order to displace a metal sheet during the operation of successive punch/die pairs.

This disadvantage leads to a reduced capacity of the known punching machines.

The main object of this invention is, consequently, that of making available an automatic punching machine having structural and functional characteristics such as to eliminate the said dead times and to reduce substantially the consumption of time involved in the displacement of a metal sheet by the manipulator.

SUMMARY OF THE INVENTION

This object is achieved, according to the invention, by an automatic punching machine for performing punching of a metal sheet in a programmed and programmable manner, comprising a punching head provided with a plurality of punch/die pairs and a numerically controlled programmable manipulator equipped with means for gripping the said metal sheet to displace it over a horizontal plane passing between the said punches and their associated dies, the improvement consisting in that a plurality of operative positions are defined in the said punching head at each of said operative positions the punching head supports an associated punch/die pair of the said plurality of pairs, each punch/die pair being operated independently from the others by respective means.

In accordance with a preferred embodiment, the said operating head includes two essentially parallelepiped superimposed blocks spaced from one another by a distance such as to allow the insertion between them, and the displacement of a metal sheet to be punched, a plurality of seats formed in each of the said blocks, each seat of a block being coaxial with a corresponding seat of the other block thus forming a pair of seats for receiving a respective punch/die pair, the axis of each of the said pairs of seats constituting one of the said plurality of the said operative positions.

Advantageously at least a part of the said pair of coaxial seats is formed in respective carriers insertable in and removable from the said blocks of the punching head.

BRIEF DESCRIPTION OF THE DRAWINGS

Further characteristics and advantages of the invention will become more apparent from the description of an embodiment of automatic punching machine according to the invention, hereinafter made with reference to the attached drawings, given purely by way of indicative example and in which.

DESCRIPTION OF A PREFERRED EMBODIMENT

Figure 1:
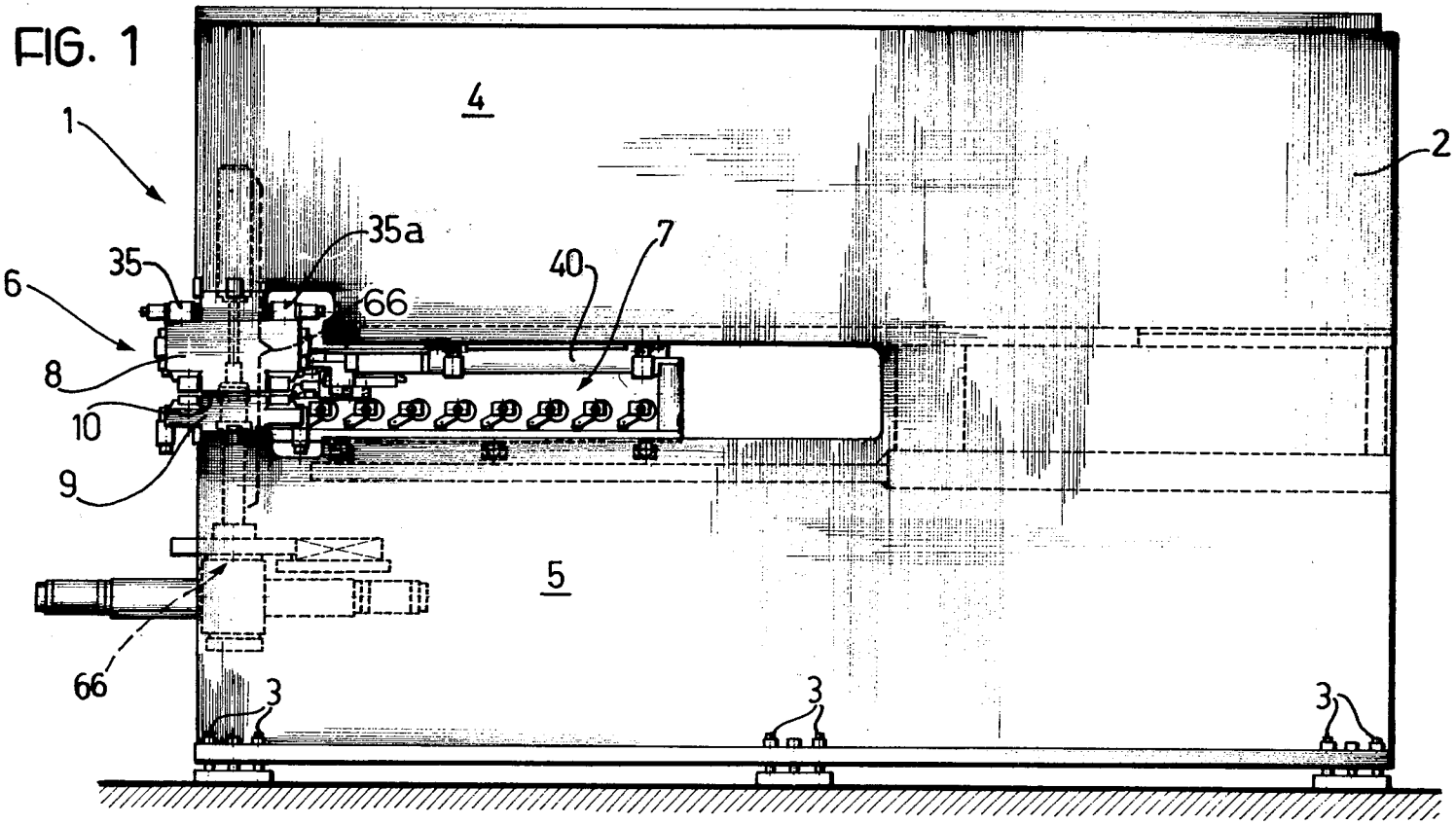
FIG. 1 is a schematic side view of a punching machine according to the invention.
Figure 2:
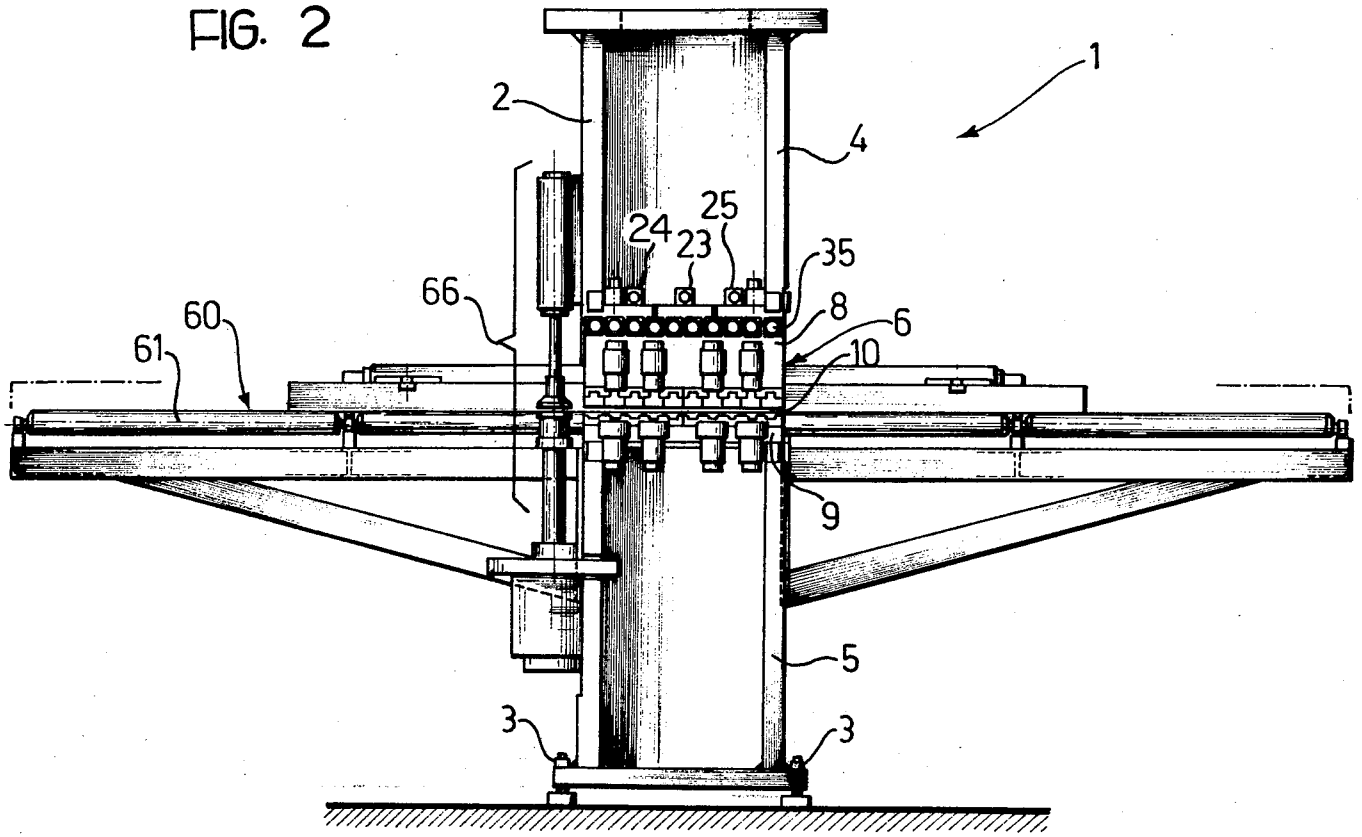
FIG. 2 is a front view of the same punching machine as in FIG. 1.

With reference to FIGS. 1 and 2, there is generally indicated a punching machine 1 according to the invention, the support structure of which is indicated 2 and is fixed to the base with conventional means 3. The support structure 2 has a very deep C-shape, with upper 4 and lower 5 horizontal arms.

At their free ends these arms 4 and 5 support a punching head, generally indicated 6.

Between the said arms there is located a manipulator 7.

The punching head 6 comprises two superimposed parallelepiped blocks 8, 9 spaced from one another by a predetermined distance so as to form a horizontal passage 10 able to allow the insertion and all the displacements in a horizontal plane of a metal sheet to be subjected to punching. The said passage 10 therefore constitutes the working region of the punching machine of this invention.

In the block 8, which is fixed with conventional means, not shown, to the upper arm 4 of the support structure 2, there is formed a plurality of seats having vertical axes, each of which is intended to receive a respective punch.

Figure 4:
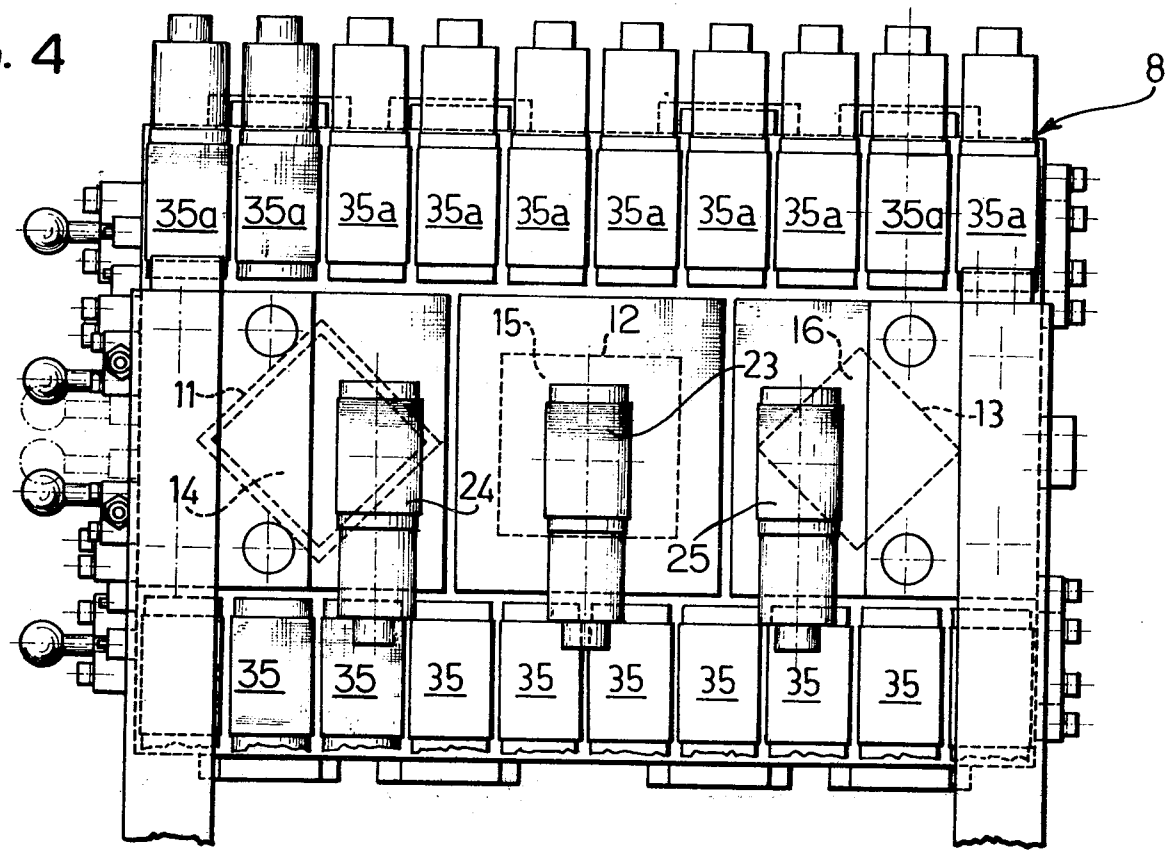
FIGS. 4 and 5 represent, on an enlarged scale and, respectively, in plan view from above and in front view, the punching head of the machine of the preceding figures.
Figure 5:
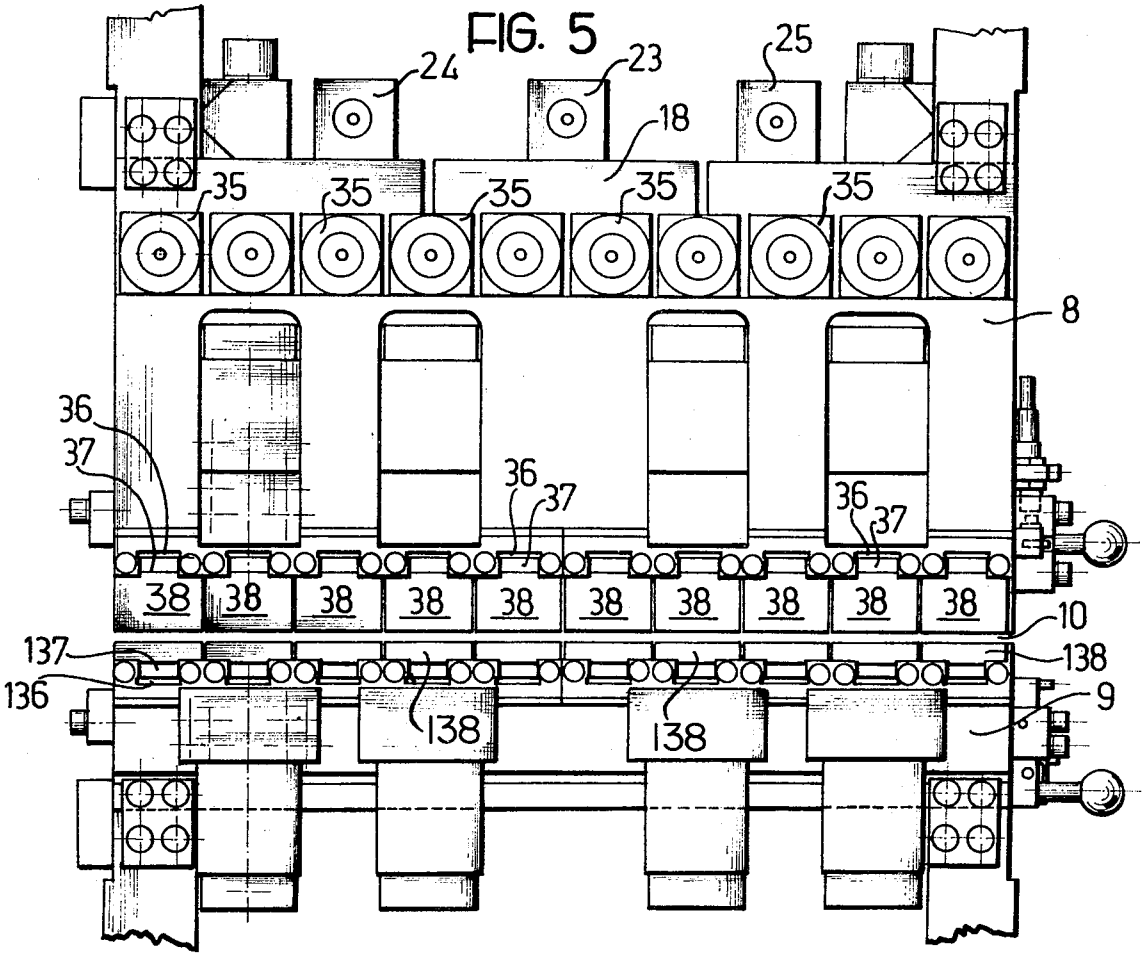
Figure 6:
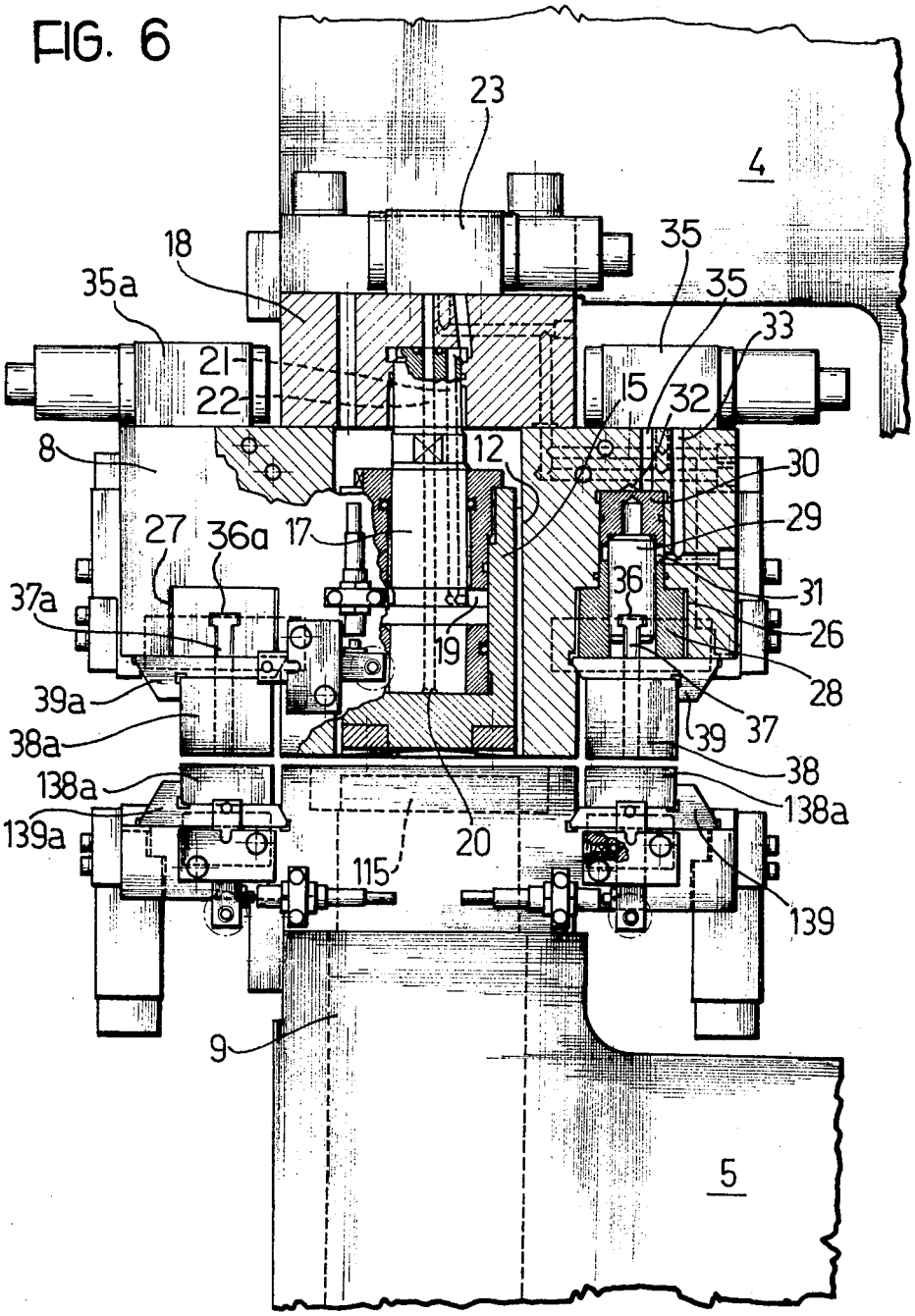
FIG. 6 represents, in partial section, the punching head of FIG. 5 seen from the side.

With reference to FIGS. 4, 5 and 6, according to a preferred and non limitative embodiment, in a median longitudinal portion of the block 8 there are formed seats 11, 12 and 13 in which are positioned, and movably guided, respective punches 14, 15 and 16. Whilst the punch 14 is utilised to effect deformations (recess) of predetermined shape, the punches 15 and 16 are utilised to effect different formations of the edges of a metal sheet.

With particular reference to FIG. 6, the punch 15 constitutes the movable cylindrical body of a vertical axis double acting hydraulic piston/cylinder unit. The fixed stem 17 of the said unit, which is rigidly connected to the block 8 through an associated plate 18, forms with the punch 15 two chambers 19,20 to each of which leads a respective oil duct 21,22. The flows of oil in the said ducts for the vertical movement of the punch 15 are controlled by a conventional solenoid valve 23. The punches 14 and 16 are constructed and controlled in entirely similar manner to the said punch 15, and for this reason are not described in detail. In FIG. 4 the solenoid valves associated with the said punches 14 and 16 are indicated 24 and 25.

In the longitudinal side portions of the block 8 there are formed seats respectively indicated 26 and 27 (in the illustrated example: 10 seats on each side). Still with reference to FIG. 6, in each of the said seats 26 (27) there is located a vertical axis double acting hydraulic piston/cylinder unit constituted by a cylindrical guide bush 28, a stem 29, a piston 30 and two chambers 31, 32 to which lead respective oil ducts 33,34. The flow of oil in these ducts is controlled by a solenoid valve 35 (35*a*) preferably mounted on the block 8.

At the lower end of the stem 29 there is formed a recessed seat 36 (36*a*) in which is engaged a punch 37 (37*a*) which extends through a small block 38 (38*a*) which serves as a guide for the punch itself. Advantageously the plurality of guide blocks 38 (38*a*) with their associated punches 37 (37*a*) slidable within them, are mounted and fixed in carriers 39 (39*a*) in their turn removably mounted and fixed with conventional means (not shown) to the block 8.

In the block 9 which is fixed with conventional means (not shown) to the lower arm 5 of the support structure 2, there are formed seats with vertical axes for receiving associated movably guided dies. Each of these seats is coaxial with a corresponding seat formed in the block 8 and each die obviously has a corresponding form to that of the associated punch to effect, when required, the desired punching of a metal sheet. In the drawings, the seats and the associated dies of the block 9 are indicated with the same reference numerals as the corresponding seats and punches of the block 8, but increased by 100.

On the block 9 there are mounted hydraulic cylinders and their associated distribution valves (solenoid valves) for those dies which are expected to have a double acting operation.

In the punching head 6 thus formed, there are defined as many operative positions as there are punch/die pairs, and each punch/die pair is operable independently from the others. These are two fundamental characteristics of the punching machine of the present invention.

The manipulator 7 is essentially constituted by two arms 40,41 extending along and movable in directions perpendicular from one another.

The arm 40 extends centrally and longitudinally with respect to the arms 4 and 5 of the support structure 2 and is supported by means of, for example, the engagement of a plurality of pairs of wheels, schematically indicated 42 and 43 (FIGS. 8, 9) with rectilinear rails 44 fixedly supported on the structure 2.

In accordance with a preferred but not limitative embodiment, a rack 45 is utilised for the movement of the arm 40, this rack being longitudinally fixed to the top of the arm itself and being in engagement with a first pinion 46, driven by an hydraulic motor 47, and with a second pinion 48 driven by a dc electric motor 49. The motors 47, 49 are supported in fixed positions by the support structure 2. The motors 47, 49 co-operate both in the rapid displacement of the arm 40 and in braking it, as well as in taking up the play between the teeth of the rack and of the pinions mentioned above.

Figure 7:
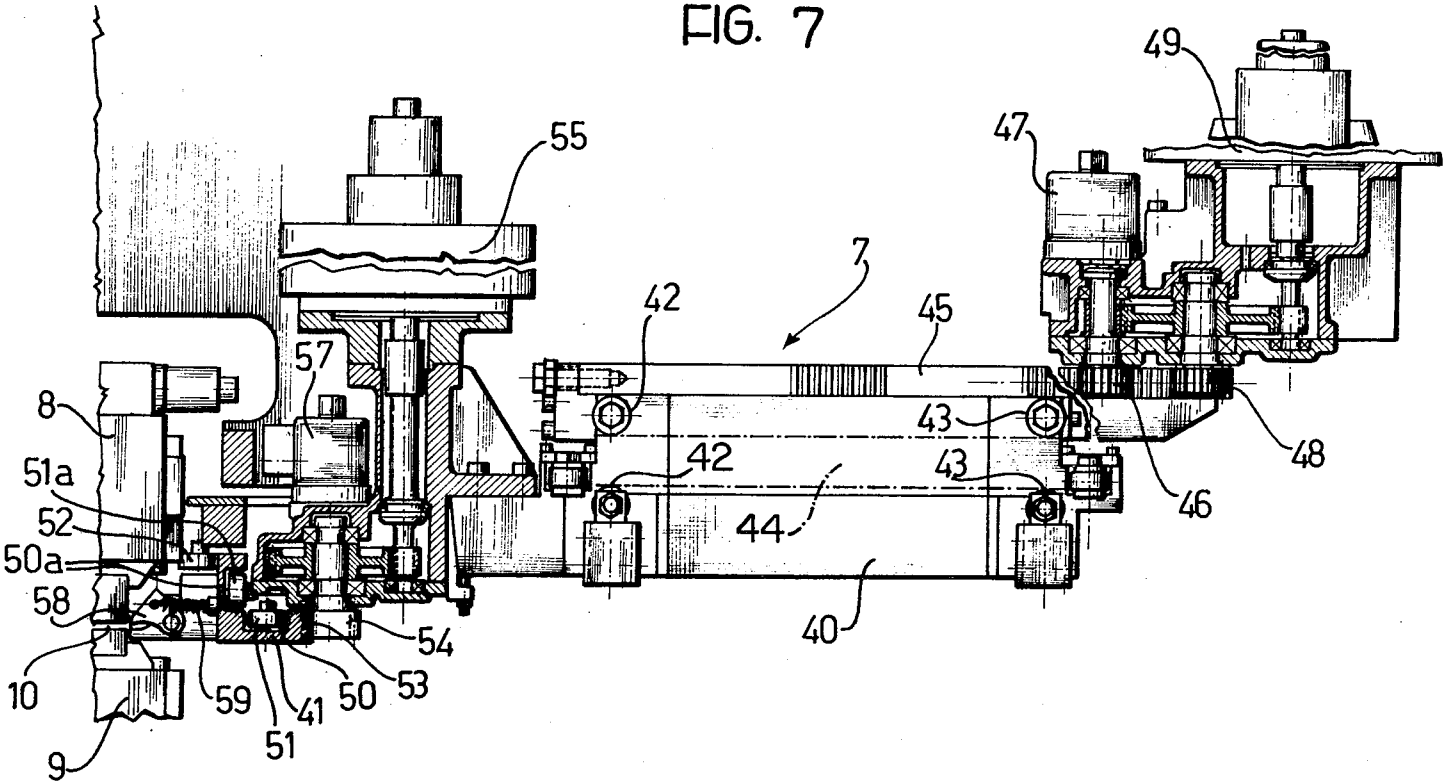
FIG. 7 is a longitudinal section of the manipulator of the punching machine of FIG. 1.

The arm 41 is mounted transversely on the arm 40 close to its end facing the punching head 6, and is movably guided in a direction perpendicular to the direction of displacement of the arm 40. For this purpose, in the arm 41 (FIG. 7) there are formed two longitudinally extending channels 50 and 50*a* with which two pluralities of wheels 51, 51*a* are in rolling engagement, these wheels being supported freely by the arm 40. A third plurality of free wheels 52 completes the desired support of the arm 41. Similar to what has been described for the arm 40, there is utilised, for the movement of this arm 41, a rack 53, longitudinally fixed to it or integrally formed with it and in engagement with a first pinion 54 moved by a dc motor 55 and with a second pinion 56 moved by an hydraulic motor 57, the said motors both being mounted on the arm 40.

On the side opposite the rack 53, the arm 41 is equipped with a plurality of pincers 58 and associated operating means 59 for gripping a metal sheet along one edge thereof.

Figure 3:
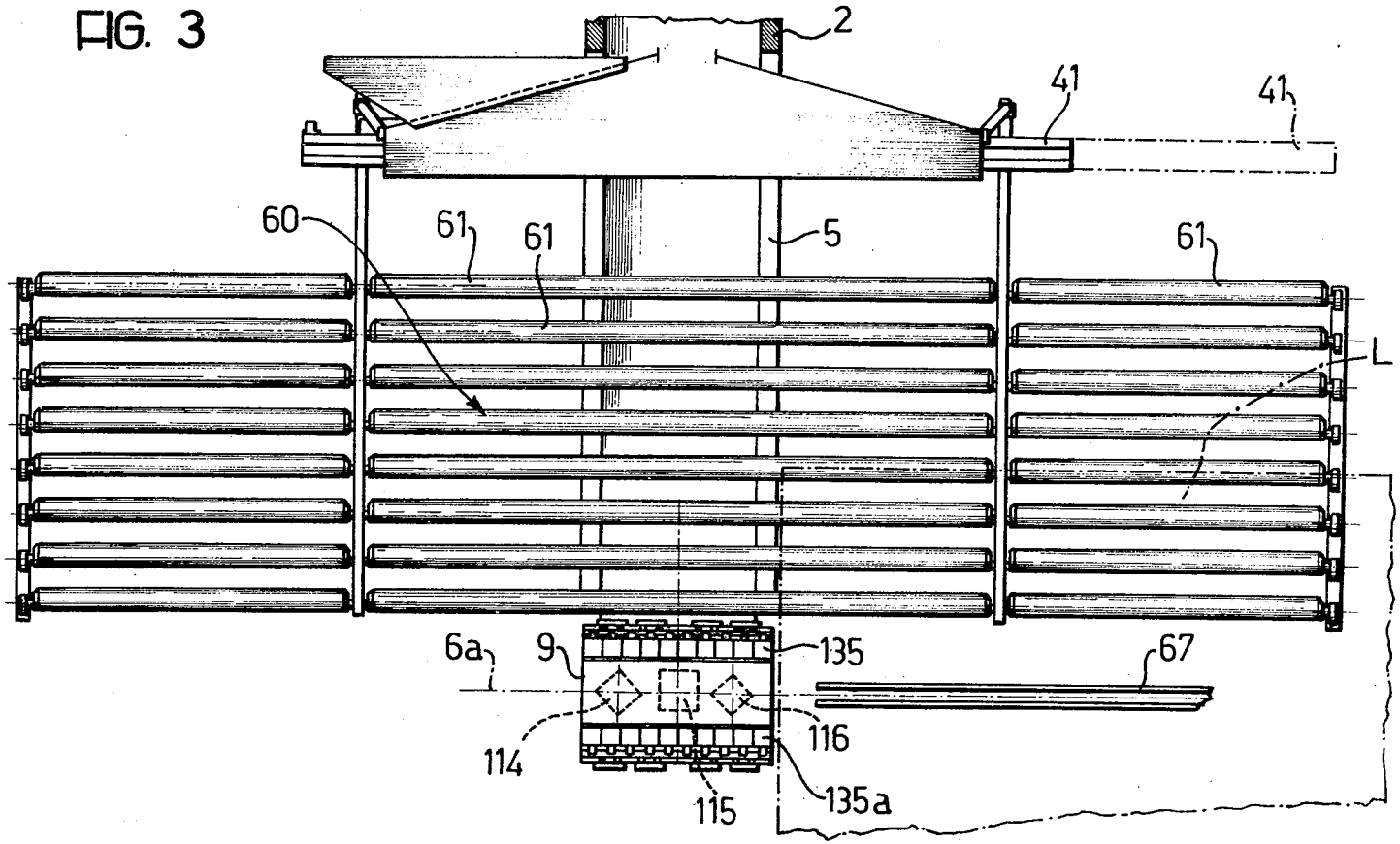
FIG. 3 is a section taken along the line III—III of FIG. 2.
Figure 8:
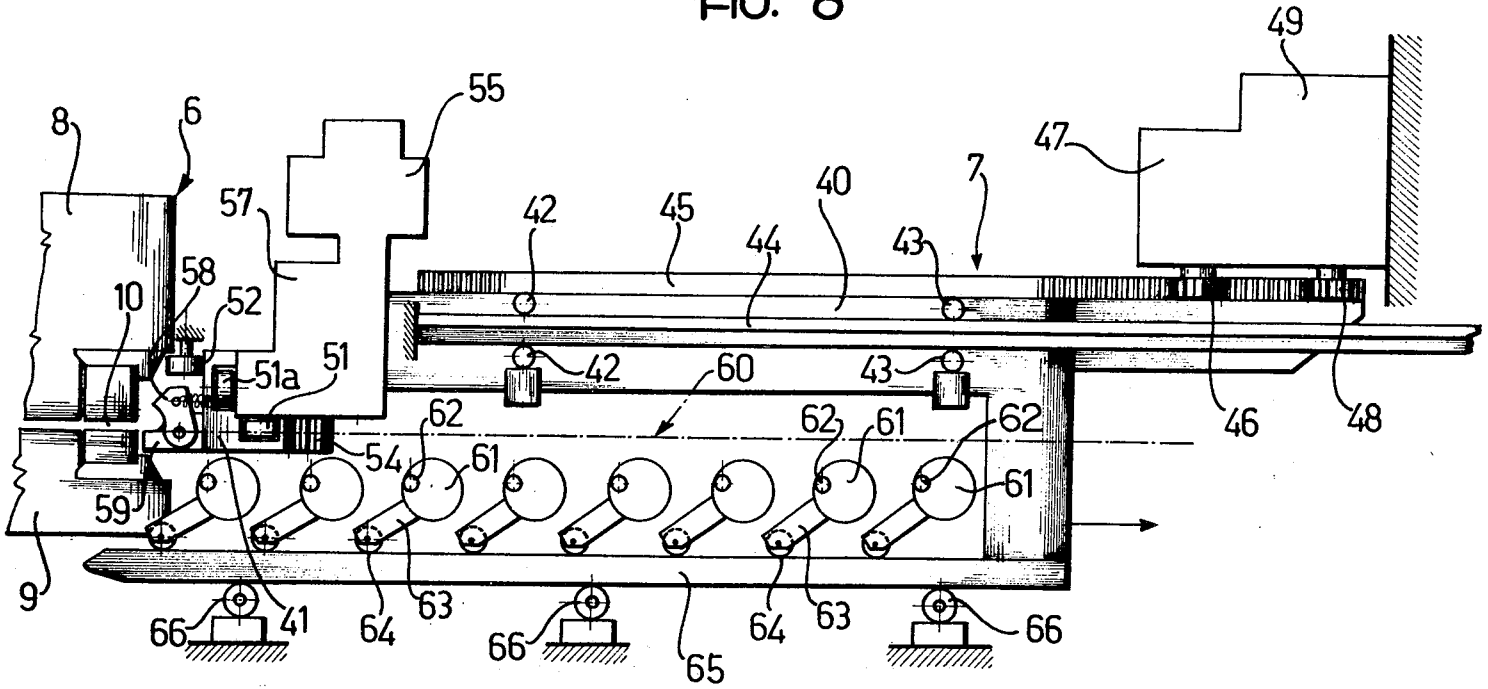
FIGS. 8 and 9 represent the same manipulator as in FIG. 7 in two different operating positions.
Figure 9:
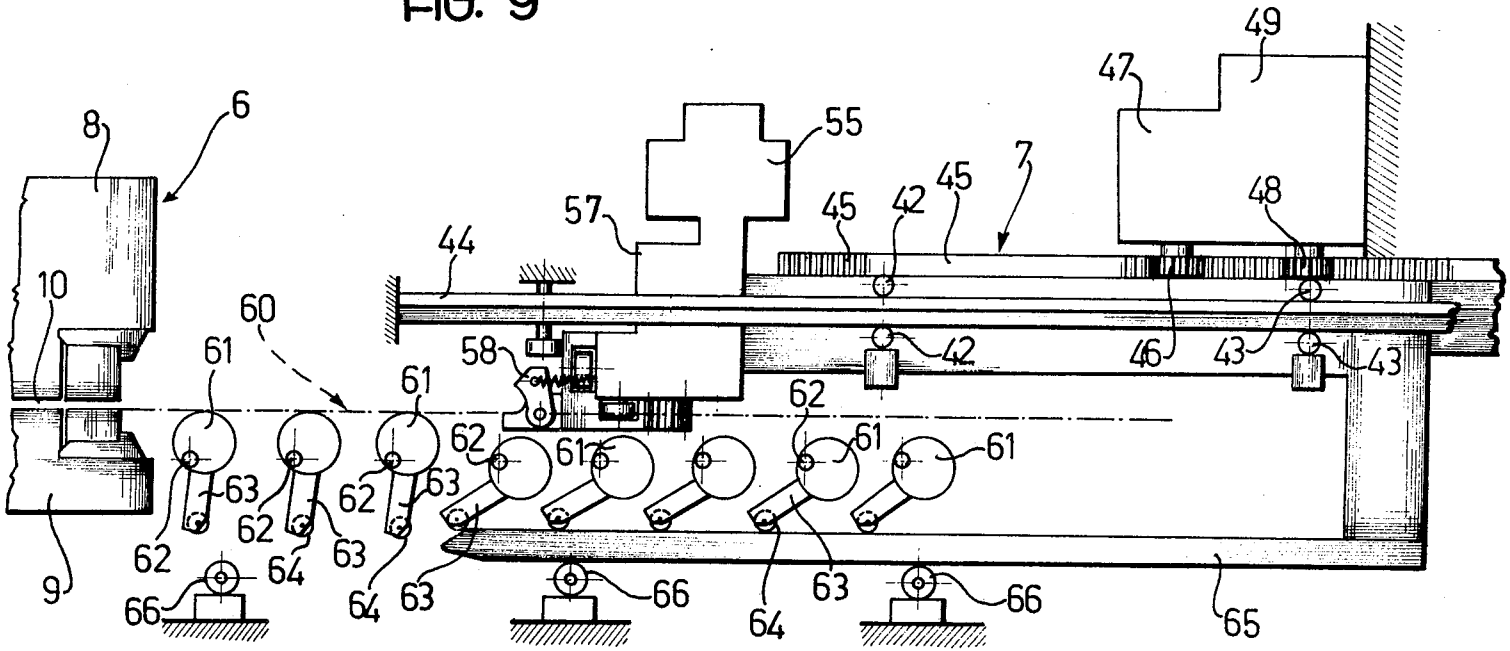

With reference to FIGS. 3, 8 and 9, a support plane for receiving and supporting a metal sheet to be subjected to punching operations is generally indicated 60. This support plane is constituted by a plurality of cylindrical rods all indicated 61, extending parallel to the arm 41 of the manipulator. Each rod 61 is mounted eccentrically on a pivot pin 62 and is provided with a rod-like projection 63 at the free end of which there is mounted a free wheel 64.

One (or more) rectilinear shaft, indicated 65, is rigidly supported by the arm 40 of the manipulator 7 and extends beneath and parallel to it. The rectilinearity of the said shaft 65 during alternate displacements of the arm 40 is ensured by a plurality of appropriate supports 65*a*.

The free end of the shaft 65 is tapered towards the punching head 6. The dimensional characteristics of the shaft 65 and its position are predetermined in such a way that, during advancing movement of the arm 40 towards the punching head 6 its tapered free end comes into contact with the wheels 64 of the rods 61 as is shown in FIGS. 8 and 9. It is to be noted that the said tapered free end of the shaft 65 projects by a predetermined distance in front of the plurality of pincers 58 with which the arm 41 of the manipulator 7 is equipped.

When the manipulator 7 is fully retracted, that is to say in the position spaced furthest from the punching head 6, the shaft 65 does not interfere with the rods 61 which, because of the eccentricity and of the action of resilient means, not shown, assume a raised position. In this position the upper generatrices of all the rods 61 lie in a single horizontal plane indicated by the dot and dash line in FIG. 9, which coincides with the working plane of the block 9 of the punching head 6 and which constitutes the plane for receiving and supporting a metal sheet to be subjected to punching. Gradually as the manipulator advances towards the operating head the shaft 65 causes a lowering of the rods 61. The plane defined by the rods 61 is substantially a progressively disappearing plane.

The punching machine of this invention is equipped with a rotator 66, positioned laterally of the punching head 6 to rotate the metal sheet by 90° or 180° in one direction or the other.

Advantageously the said rotator 66 is of the type illustrated and described in U.S. patent application Ser. No. 941,988 of Sept. 13, 1978, now U.S. Pat. No. 4,242,898, filed in the name of the same applicant and mentioned for reference purposes. With the automatic punching machine described above, the punching of a metal sheet is performed in accordance with the following method.

The punching machine is pre-arranged to receive a metal sheet L. For this purpose (FIG. 3) the manipulator 7 is retracted sufficiently, with respect to the punching head 6, and the arm 41 of the manipulator is sufficiently displaced laterally in such a way that all the pincers 58 with which it is equipped are laterally displaced with respect to the head 6. In FIG. 3 this position of the arm 41 of the manipulator is indicated with a dot and dash line. Because the manipulator 7 is in the said position, the rollers 61 are in the "raised" position constituting the plane for receiving and supporting the said metal sheet L.

The metal sheet L. is carried into the said support plane, arriving in position from one side to the punching head 6, for example by means of a conventional conveyor indicated 67. The positioning of the said sheet L is such that its longitudinal median line coincides with the longitudinal median line of the punching head 6, indicated 6*a* in FIG. 3. At this point the manipulator 7 is made to advance until the pincers 58 of the arm 41 can press the sheet against suitable references, not shown since they are conventional, and then grip the edge of the metal sheet. The manipulator 7, by means of suitable and exact displacements of its arms 40 and 41, controlled by means of a process computer on the basis of a predetermined programme, provides for subsequent positioning of the metal sheet L between the blocks 8, 9 of the punching head 6 so that on the half thereof opposite the edge gripped by the pincers 58 all the different and predetermined punching can be successively performed. Naturally the system for controlling the displacements of the arms 40 and 41 of the manipulator must take account both of the co-ordinates of the points of the metal sheet in which the different punching is to be performed, and of the co-ordinates of the associated punches.

When the punching of the first half of the metal sheet has been completed, the said sheet is taken by the rotator 66, released from the pincers 58, rotated through 180°, gripped again by the pincers 58 and taken back to the working region of the manipulator 7 where the desired different punching on the second half of the sheet itself is effected.

When it is desired to effect the punching of portions of the metal sheet extending perpendicularly each other, after the punching of a portion the metal sheet is caused to rotate through 90° by the said rotator.

The main advantages achieved by the punching machine of this invention are, fundamentally, as follows:

during the working cycle the dead times for the substitution of punches and associated dies are completely eliminated;

the path which the manipulator must follow for the execution of a given number of punchings of different shapes is radically reduced.

As a consequence a considerable increase in the productivity of the punching machine is obtained.

What is claimed is:

1. An automatic punching machine for performing punching of a metal sheet in a programmed and programmable manner, comprising, in combination, a punching head provided with a plurality of independently operable punch and die pairs arranged at respective operative positions of the punching head, a numerically controlled programmable manipulator equipped with gripping means for gripping the metal sheet and with first and second driving means for displacing said gripping means in first and second horizontal directions perpendicular to one another, and a rotator for rotating the metal sheet through desired angles about a vertical axis, said manipulator including a first horizontal arm movable in the first direction and a second horizontal arm mounted on said first arm and movable in said second horizontal direction, said second arm being equipped with the said means for gripping the metal sheet, and motor means for rectilinear alternating displacements of the said arms independently from one another, a disappearing plane is provided for receiving and supporting the metal sheet to be punched, said plane being defined by a plurality of rods extending parallel to said second arm of the manipulator and eccentrically mounted on pivot pins so as to be normally held in raised position, said manipulator further including a rectilinear shaft fixed to and extending parallel to said first arm in such a position as to engage progressively said rods and to displace the same to a lowered position during the advancing movement of said first arm of the manipulator.

2. A punching machine according to claim 1, in which the said punching head comprises two superimposed parallelepiped blocks spaced from one another by a predetermined distance able to allow the insertion between them and the displacement of said metal sheet, a plurality of seats formed in each of the said blocks, each seat of one block being coaxial with a corresponding seat of the other block to form a pair of seats for receiving an associated punch and die pair.

3. A punching machine according to claim 2, in which means for operating each punch and die pair are mounted on the associated blocks of the said punching head.

4. A punching machine according to claim 1, in which said rotator is disposed alongside the said punching head and includes means for rotating the metal sheet through 180° in one rotational sense or the other.

5. A punching machine according to claim 1 the motor means includes a rack rigidly connected to said second arm, a first pinion meshing with the said rack and moved by an electric motor, and a second pinion meshing with the said rack and moved by a hydraulic motor.

6. A punching machine according to claim 5, wherein said electric motor and said hydraulic motor are mounted on said first arm.

* * * * *